US008174203B2

(12) United States Patent
Kim et al.

(10) Patent No.: US 8,174,203 B2
(45) Date of Patent: May 8, 2012

(54) LAMP DRIVING CIRCUIT

(75) Inventors: Ju Rae Kim, Suwon-si (KR); Jong Rak Kim, Suwon-si (KR); Min Jin Kim, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 302 days.

(21) Appl. No.: 12/431,973

(22) Filed: Apr. 29, 2009

(65) Prior Publication Data

US 2010/0253243 A1 Oct. 7, 2010

(30) Foreign Application Priority Data

Apr. 2, 2009 (KR) ..... 10-2009-0028364

(51) Int. Cl.
*H05B 41/16* (2006.01)
*H05B 41/24* (2006.01)

(52) U.S. Cl. ..... 315/278; 315/279; 315/282; 315/291

(58) Field of Classification Search ..... 315/209 R, 315/276–279, 282, 291
See application file for complete search history.

(56) References Cited

U.S. PATENT DOCUMENTS

| | | | | |
|---|---|---|---|---|
| 7,365,501 | B2 * | 4/2008 | Ushijima et al. | 315/278 |
| 7,477,023 | B2 * | 1/2009 | Shimura et al. | 315/282 |
| 7,667,411 | B2 * | 2/2010 | Kim et al. | 315/282 |
| 7,710,046 | B2 * | 5/2010 | Park et al. | 315/274 |
| 7,728,708 | B2 * | 6/2010 | Fushimi et al. | 336/212 |
| 2006/0284568 | A1 | 12/2006 | Chang et al. | |
| 2007/0001622 | A1 * | 1/2007 | Chan et al. | 315/282 |
| 2007/0126369 | A1 * | 6/2007 | Meng et al. | 315/282 |
| 2007/0152607 | A1 * | 7/2007 | Chen | 315/282 |
| 2008/0067951 | A1 * | 3/2008 | Hsu et al. | 315/277 |
| 2009/0039800 | A1 * | 2/2009 | Kimura | 315/307 |
| 2010/0060191 | A1 * | 3/2010 | Ashikaga et al. | 315/291 |

FOREIGN PATENT DOCUMENTS

| | | |
|---|---|---|
| KR | 1020040073320 | 8/2004 |
| KR | 1020070080471 | 8/2007 |

OTHER PUBLICATIONS

Office Action for Korean Application No. 10-2009-0028364 mailed Nov. 5, 2010.
Notice of Allowance for Korean Application No. 10-2009-0028364 mailed Jul. 27, 2011.

* cited by examiner

*Primary Examiner* — Jason M Crawford
(74) *Attorney, Agent, or Firm* — Lowe, Hauptman, Ham & Berner, LLP

(57) ABSTRACT

A lamp driving circuit includes a first printed circuit board and a second printed circuit board. The first printed circuit board includes a switching unit for switching an input power source, a control unit for controlling the switching unit, an inverter transformer connected to the switching unit, and a voltage conversion unit for converting a feedback reference current for controlling an output current applied from the inverter transformer into a reference voltage and applying the reference voltage to the control unit. The voltage conversion unit is connected to the inverter transformer and the control unit. The voltage conversion unit is connected to a first feedback terminal. The second printed circuit board includes a plurality of balance coils connected to a plurality of lamps so that the same output currents are applied to the lamps, a second feedback terminal connected to the first feedback terminal, and a current conversion unit connected to the second feedback terminal.

9 Claims, 2 Drawing Sheets

[FIG. 1]
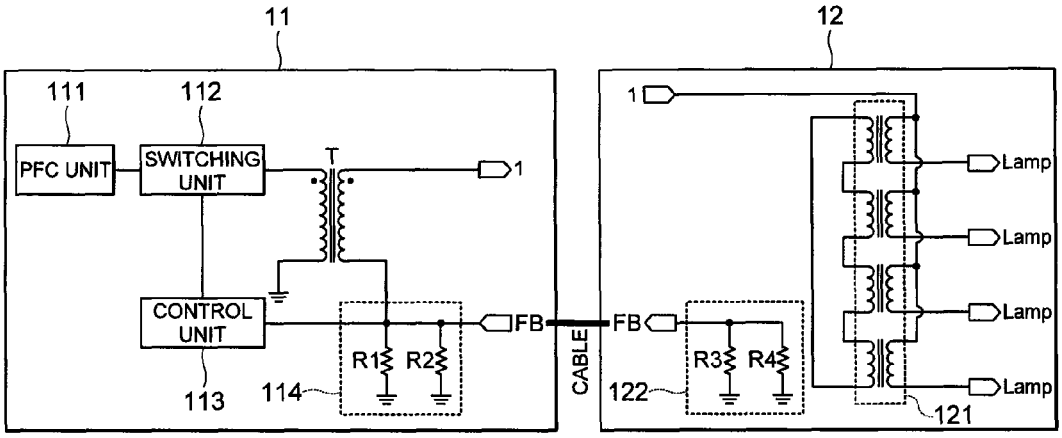

[FIG. 2]
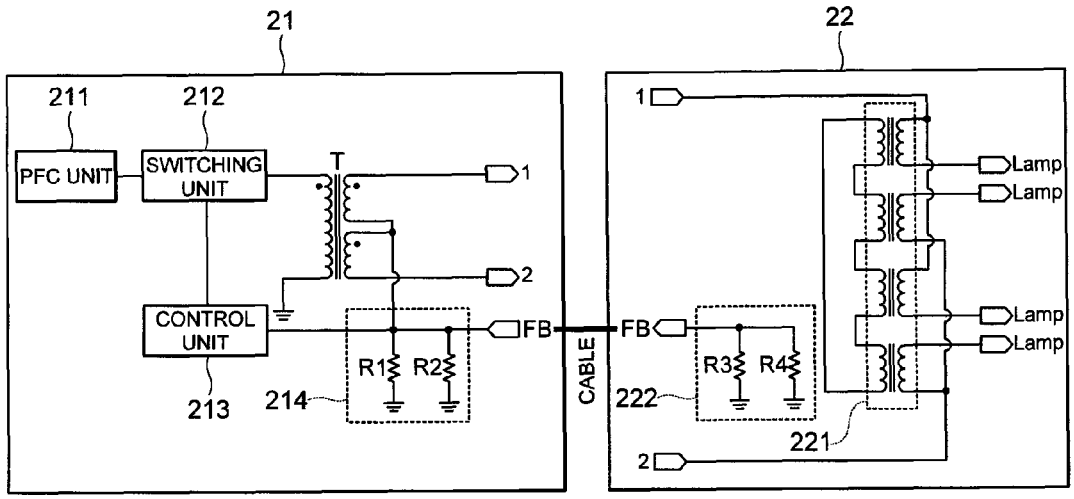

LAMP DRIVING CIRCUIT

CROSS-REFERENCE TO RELATED APPLICATIONS

This application claims the benefit of Korean Patent Application No. 10-2009-0028364 filed with the Korea Intellectual Property Office on Apr. 2, 2009, the disclosure of which is incorporated herein by reference.

BACKGROUND OF THE INVENTION

1. Field of the Invention

The present invention relates to a lamp driving circuit; and, more particularly, to a lamp driving circuit to receive a feedback reference current for controlling a lamp output current from an inverter transformer.

2. Description of the Related Art

With development of display technology, an LCD(Liquid Crystal Display) has been increasingly widely used in a TV and a monitor. As for the LCD and a CRT(Cathode-Ray Tube) monitor, the LCD has advantages in that a longitudinal cross-section is slimmed and flicker is reduced.

The LCD needs a back-light unit for supplying a light source because it does not emit light spontaneously and the back-light unit has a fluorescent lamp which is driven with a high voltage.

Meanwhile, in order to drive the fluorescent lamp of the back-light unit, a lamp driving circuit including an inverter is used.

The lamp driving circuit may be formed of an SMPS(Switching Mode Power Supply) and two printed circuit boards, i.e., an IP(Integrated Power) board mounting the inverter and a balance board.

At this time, the same inch of IP board is commonly used for common use of products and if there are many manufacturers of the back-light units used for the same inch, lamp output currents may be different to maintain the same brightness according to the manufacturers.

Further, since the lamp output currents may be different due to difference in the number of lamps and difference in brightness among the same inch and back-light unit manufactures, it is needed to control the lamp output currents so as to prevent product failure.

Therefore, in order to control the lamp output currents, a current transformer has been used in the balance board without change of the IP board, which increases a material cost due to addition of parts and may cause quality problems.

SUMMARY OF THE INVENTION

The present invention has been proposed in order to overcome the above-described problems and it is, therefore, an object of the present invention to provide a lamp driving circuit to receive a feedback reference current for controlling a lamp output current from an inverter transformer of an IP board.

In accordance with one aspect of the present invention to achieve the object, there is provided a lamp driving circuit including: a first printed circuit board and a second printed circuit board, wherein the first printed circuit board includes a switching unit for switching an input power source; a control unit for controlling the switching unit; an inverter transformer connected to the switching unit; and a voltage conversion unit for converting a feedback reference current for controlling an output current applied from the inverter transformer into a reference voltage to apply the reference voltage to the control unit by being connected to the inverter transformer, the voltage conversion unit is connected to a first feedback terminal, and the second printed circuit board includes a plurality of balance coils connected to a plurality of lamps so that the same output currents are applied to the lamps; and a current conversion unit connected to a second feedback terminal.

In accordance with the present invention, the voltage conversion unit includes a plurality of resistors connected in parallel.

In accordance with the present invention, the first feedback terminal and the second feedback terminal are connected through a cable.

In accordance with the present invention, the current conversion unit includes a plurality of resistors connected in parallel.

In accordance with the present invention, the first printed circuit board further includes a PFC(Power Factor Correction) unit for meeting harmonic regulation and the PFC unit is connected to the switching unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a view illustrating an in-phase lamp driving circuit in accordance with one embodiment of the present invention; and FIG. 2 is a view illustrating an inverse phase lamp driving circuit in accordance with another embodiment of the present invention.

DETAILED DESCRIPTION OF THE PREFERABLE EMBODIMENTS

The present invention may include several embodiments through various modifications, wherein specific embodiments are exemplified in the accompanying drawings and will be explained in detail, hereinafter. However, it should be understood that the present invention is not limited to the specific embodiments and includes all modifications, equivalents and substitutions falling within the spirit and technical scope of the present invention. In description of the present invention, if it is determined that detailed description of related published techniques makes the gist of the present invention vague; the detailed description thereof will be omitted.

Although terms such as "first" and "second" may be used in order to describe various components, the components should not be limited by the terms. The terms are used only to distinguish one component from the other components.

The terms of this application are used only to describe the specific embodiments, but are not to be construed to limit the present invention. A singular form includes a plural form as long as the singular form does not clearly indicate a different thing from the plural form. It should be understood that in this application, terms such as "include" or "have" specify existence of a characteristic, a figure, a step, an operation, a component, a part or a combination thereof which are described in the specification but do not previously exclude existence or possibility of addition of one or more different characteristics, figures, steps, operations, components, parts or combinations thereof.

Hereinafter, embodiments of a lamp driving circuit in accordance with the present invention will be described in detail with reference to the accompanying drawings. In describing them with reference to the accompanying drawings, the same or corresponding component will be represented by the same reference numeral and repeated description thereof will be omitted.

FIG. 1 is a view illustrating an in-phase lamp driving circuit in accordance with one embodiment of the present invention.

Hereinafter, the in-phase lamp driving circuit will be described with reference to FIG. 1.

The in-phase lamp driving circuit in accordance with one embodiment of the present invention includes a first printed circuit board 11 and a second printed circuit board 12.

At this time, the first printed circuit board 11 may be an IP(Integrated Power) board and the second printed circuit board 12 may be a balance board.

The first printed circuit board 11 mounts a switching unit 112, a control unit 113, an inverter transformer T and a voltage conversion unit 114.

The switching unit 112 switches an input power source and supplies it to the inverter transformer.

The control unit 113 can control the switching unit 112 according to lamp output currents.

The inverter transformer T generates a high AC output voltage with a low pulse input voltage and supplies a current to a lamp constituting an LCD panel.

The inverter transformer T has a primary side and a secondary side. One end of the primary side is connected to the switching unit 112 and the other end thereof is connected to a ground. One end of the secondary side is connected to a first output terminal 1 and the other end thereof is connected to the voltage conversion unit 114

The voltage conversion unit 114 is connected to the other end of the secondary side of the inverter transformer T. The voltage conversion unit 114 converts a feedback reference current which is applied from the inverter transformer T and controls the lamp output currents, into a reference voltage to supply it as input of the control unit 113.

The voltage conversion unit 114 is formed of a plurality of resistors R1 and R2 which are connected to each other in parallel. The feedback reference current applied from the inverter transformer T is converted into the reference voltage supplied to the control unit 113 by using the resistors R1 and R2 connected in parallel.

One end of the voltage conversion unit 114 is connected to the control unit 113 and the other end thereof is connected to a first feedback terminal FB.

Further, the first printed circuit board 11 further includes a PFC(Power Factor Correction) unit 111 to meet harmonic regulation and the PFC unit 111 is connected to the switching unit 112.

The second printed circuit board 12 includes a plurality of balance coils 121 and a current conversion unit 122.

The balance coils 121 are connected to a plurality of lamps so that the same output currents can be applied to the lamps. The balance coils 121 are connected to a first output terminal 1 and the first output terminal is connected to the first output terminal 1 of the first printed circuit board 11.

The current conversion unit 122 is connected to a second feedback terminal FB and can achieve current conversion according to difference in the number of lamps and brightness according to back-light unit manufacturers and objects of back-light units.

The current conversion unit 122 includes a plurality of resistors R3 and R4 connected in parallel. A current converted through the current conversion unit 122 is supplied to the first printed circuit board 11 through the second feedback terminal FB. At this time, the second feedback terminal FB is connected to the first feedback terminal FB of the first printed circuit board 11 through a cable.

The in-phase lamp driving circuit in accordance with the one embodiment of the present invention can perform a function of controlling the lamp output current only through position change of conventional parts without addition of a new part after omitting a current transformer of a conventional lamp driving circuit.

FIG. 2 is a view illustrating an inverse phase lamp driving circuit in accordance with another embodiment of the present invention.

Hereinafter, the inverse phase lamp driving circuit is described with reference to FIG. 2.

The inverse phase lamp driving circuit in accordance with another embodiment of the present invention includes a first printed circuit board 21 and a second printed circuit board 22.

At this time, the first printed circuit board 21 may be an IP(Integrated Power) board and the second printed circuit board 22 may be a balance board.

The first printed circuit board 21 includes a switching unit 212, a control unit 213, an inverter transformer T, and a voltage conversion unit 214.

The switching unit 212 switches an input power source and supplies it to the inverter transformer.

The control unit 213 can control the switching unit 112 according to lamp output currents.

The inverter transformer T generates a high AC output voltage with a low pulse input voltage and supplies a current to a lamp constituting an LCD panel.

The inverter transformer T has one primary side and two secondary sides, i.e., a first secondary side and a second secondary side. One end of the primary side is connected to the switching unit 212 and the other end thereof is connected to a ground. One end of the first secondary side is connected to a first output terminal 1 and the other end thereof is connected to one end of the second secondary side. Further, the other end of the second secondary side is connected to a second output terminal 2.

The voltage conversion unit 214 is connected to a contact between the other end of the first secondary side and the one end of the second secondary side of the inverter transformer T. The voltage conversion unit 214 converts a feedback reference current which is applied from the inverter transformer T and controls the lamp output currents, into a reference voltage to supply it as input of the control unit 213.

The voltage conversion unit 214 is formed of a plurality of resistors R1 and R2 which are connected to each other in parallel. The feedback reference current applied from the inverter transformer T can be converted into the reference voltage supplied to the control unit 213 by using the resistors R1 and R2 connected in parallel.

One end of the voltage conversion unit 214 is connected to the control unit 213 and the other end thereof is connected to a first feedback terminal FB.

Further, the first printed circuit board 21 further includes a PFC(Power Factor Correction) unit 211 to meet harmonic regulation and the PFC unit 211 is connected to the switching unit 212.

The second printed circuit board 22 includes a plurality of balance coils 221 and a current conversion unit 222.

The balance coils 221 are connected to a plurality of lamps so that the same output currents can be applied to the lamps. One ends of the balance coils 221 are connected to a first output terminal 1 and the first output terminal 1 is connected to the first output terminal 1 of the first printed circuit board 21. Further, the other ends of the balance coils 221 are connected to a second output terminal 2 and the second output terminal 2 is connected to the second output terminal of the first printed circuit board 21.

The current conversion unit 222 is connected to a second feedback terminal FB and can achieve current conversion according to difference in the number of lamps and brightness according to back-light unit manufacturers and objects of back-light units.

The current conversion unit 222 includes a plurality of resistors R3 and R4 connected in parallel. A current converted through the current conversion unit 222 is supplied to the first printed circuit board 21 through the second feedback terminal FB. At this time, the second feedback terminal FB is connected to the first feedback terminal FB of the first printed circuit board 21 through a cable.

The inverse phase lamp driving circuit in accordance with another embodiment of the present invention can perform a function of controlling the lamp output currents only through position change of conventional parts without addition of a new part after omitting a current transformer of a conventional lamp driving circuit.

As described above, the lamp driving circuit can omit the current transformer of the balance board and improve quality by receiving the feedback reference current for controlling the lamp output currents from the inverter transformer of the IP board.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. A lamp driving circuit, comprising:

a first printed circuit board; and a second printed circuit board, wherein the first printed circuit board includes:

a switching unit for switching an input power source;

a control unit for controlling the switching unit;

an inverter transformer connected to the switching unit;

a voltage conversion unit connected to the inverter transformer and the control unit for converting a feedback reference current for controlling an output current applied from the inverter transformer into a reference voltage to apply the reference voltage to the control unit; and a first feedback terminal connected to the voltage conversion unit, and the second printed circuit board includes:

a plurality of balance coils connected to a plurality of lamps so that the same output currents are applied to the lamps;

a second feedback terminal connected to the first feedback terminal; and a current conversion unit connected to the second feedback terminal, wherein the current conversion unit includes a plurality of resistors connected in parallel, and the reference voltage applied to the control unit is changeable by changing a resistance of the current conversion unit.

2. The lamp driving circuit of claim 1, wherein the voltage conversion unit includes a plurality of resistors connected in parallel.

3. The lamp driving circuit of claim 1, further comprising a cable via which the first feedback terminal and the second feedback terminal are connected with each other.

4. The lamp driving circuit of claim 1, wherein the second printed circuit board is devoid of any transformer other than the balance coils.

5. A lamp driving circuit, comprising:

a first printed circuit board; and a second printed circuit board different from the first printed circuit board, wherein the first printed circuit board includes:

a switching unit for switching an input power source;

a control unit having an input and an output, said output being coupled to the switching unit for controlling the switching unit;

an inverter transformer having a primary side and a secondary side, the primary side being connected to the switching unit, the secondary side including opposite first and second terminals;

a first conversion unit connected to the second terminal of the secondary side of the inverter transformer and to the input of the control unit;

a first feedback terminal connected to the first conversion unit; and at least an output terminal connected to the first terminal of the secondary side of the inverter transformer, the second printed circuit board includes:

at least an input terminal connected to the output terminal of the first printed circuit board;

a plurality of balance coils connectable to a plurality of lamps and coupled to the input terminal to supply currents from the inverter transformer to the lamps;

a second feedback terminal connected to the first feedback terminal; and a second conversion unit connected to the second feedback terminal, and said first and second conversion units are connected together via the first and second feedback terminals to convert a feedback reference current flowing at the secondary side of the inverter transformer into a reference voltage and to apply the reference voltage to the input of the control unit, wherein the second conversion unit includes a plurality of resistors connected in parallel between the second feedback terminal and an electrical ground, and the reference voltage applied to the control unit is changeable by changing a resistance of the second conversion unit.

6. The lamp driving circuit of claim 5, wherein the first conversion unit includes a plurality of resistors connected in parallel between the first feedback terminal and the electrical ground.

7. The lamp driving circuit of claim 5, further comprising a cable via which the first feedback terminal and the second feedback terminal are connected with each other.

8. The lamp driving circuit of claim 5, wherein the second printed circuit board is devoid of any transformer other than the balance coils.

9. The lamp driving circuit of claim 5, further comprising a cable which is outside both said first and second printed circuit boards and which directly connects the first feedback terminal and the second feedback terminal with each other.

* * * * *